US005502996A

United States Patent [19]

Strong et al.

[11] Patent Number: 5,502,996

[45] Date of Patent: Apr. 2, 1996

[54] CRIMPING PRESS ACTUATOR ASSEMBLY

[75] Inventors: Michael D. Strong, Mechanicsburg; Craig W. Hornung, Harrisburg, both of Pa.

[73] Assignee: The Whitaker Corporation, Wilmington, Del.

[21] Appl. No.: 354,196

[22] Filed: Dec. 12, 1994

[51] Int. Cl.[6] ..... B21J 15/24

[52] U.S. Cl. ..... 72/430; 72/707; 29/863; 29/705

[58] Field of Search ..... 72/430, 707; 29/863, 29/705, 748, 753

[56] References Cited

U.S. PATENT DOCUMENTS

| | | | |
|---|---|---|---|
| 3,343,398 | 9/1967 | Kerns | 72/413 |
| 3,783,662 | 1/1974 | Keller et al. | 72/430 |
| 3,883,839 | 5/1975 | Barrett et al. | 338/116 |
| 4,081,774 | 3/1978 | Barrett et al. | 335/228 |
| 5,197,186 | 3/1993 | Strong et al. | 72/430 |
| 5,325,699 | 7/1994 | Stuart | 72/430 |

*Primary Examiner*—David Jones

[57] ABSTRACT

A magnet actuator assembly for reciprocating a ram shaft in a crimping press. The actuator assembly comprises stationary upper and lower electromagnet members and a movable central electromagnet member coupled to the ram shaft. The mating surfaces of the electromagnet members are formed of combinations of frusto-conical and planar regions so that an adequate force at a large separation between the upper and central electromagnet members is generated to raise the central electromagnet member and a relatively large force at a small separation between the central and lower electromagnet members is generated to effect the crimping function.

12 Claims, 8 Drawing Sheets

CRIMPING PRESS ACTUATOR ASSEMBLY

BACKGROUND OF THE INVENTION

This invention relates to a crimping press having a ram shaft which is utilized repetitively to attach electrical terminals to the ends of wires and, more particularly, to an improved actuator assembly for reciprocating the ram shaft.

U.S. Pat. No. 3,343,398 discloses a conventional crimping press wherein a ram is coupled to a reciprocating shaft and, during each single revolution of the shaft, the ram is moved downwardly and then back to its initial position, thereby to move a crimping die on the end of the ram into engagement with a terminal. The shaft is coupled through a single revolution clutch to a flywheel which is continuously driven by a continuously operated motor. When it is desired to crimp a terminal onto a wire, the single revolution clutch is engaged to drive the shaft through a single revolution so that the ram is moved through its cycle.

While the aforedescribed arrangement is effective for its intended purpose, it suffers from several disadvantages. Thus, for example, continuously running the motor wastes electrical energy and generates heat. Also, the use of a single revolution clutch causes noise and vibration. Further, the clutch has to be properly maintained and worn parts have to be replaced.

It is therefore an object of the present invention to provide an improved actuator assembly which replaces a continuously running motor and a single revolution clutch.

SUMMARY OF THE INVENTION

The foregoing and additional objects are attained in accordance with the principles of this invention by providing an actuator assembly for reciprocating a ram shaft in a crimping press. The crimping press has a frame, and the ram shaft is adapted for vertical reciprocating movement within the frame. The actuator assembly comprises upper and lower electromagnet members mounted to the frame so as to be restrained from vertical movement, a central electromagnet member disposed for vertical movement within the frame between the upper and lower electromagnet members and coupled to control movement of the ram shaft, and control means for controlling the magnetization of the upper, lower and central electromagnetic members so as to effect vertical reciprocating movement of the ram shaft. The lower surface of the upper electromagnet member and the upper surface of the central electromagnet member are complementary so as to mesh one with the other and have a relatively large frusto-conical inner region and a relatively small horizontally planar region disposed outwardly of the frusto-conical inner region. Likewise, the lower surface of the central electromagnet member and the upper surface of the lower electromagnet member are complementary so as to mesh one with the other, but with a relatively small frusto-conical inner region and a relatively large horizontally planar region disposed outwardly of the frusto-conical inner region.

In accordance with an aspect of this invention, each of the electromagnet members is formed with an annular channel in its planar region and the control means includes four electrical wire windings each disposed in a respective one of the annular channels.

In accordance with another aspect of this invention, the control means further includes means for selectively energizing the windings in adjacent pairs so as to alternately cause attractive forces between the upper and central electromagnet members and between the central and lower electromagnet members.

In accordance with still another aspect of this invention, the control means includes position encoding means coupled to the central electromagnet member for providing a position signal indicative of the vertical position of the central electromagnet member.

In accordance with yet another aspect of this invention, each of the electromagnet members has a central opening, with the ram shaft extending through the central openings of all the electromagnet members. The central openings of the upper and lower electromagnet members are sufficiently large to provide clearance for the ram shaft to move freely therein.

BRIEF DESCRIPTION OF THE DRAWINGS

The foregoing will be readily apparent upon reading the following description in conjunction with the drawings in which like elements in different figures thereof are identified by the same reference numeral and wherein.

DETAILED DESCRIPTION

Figure 1:
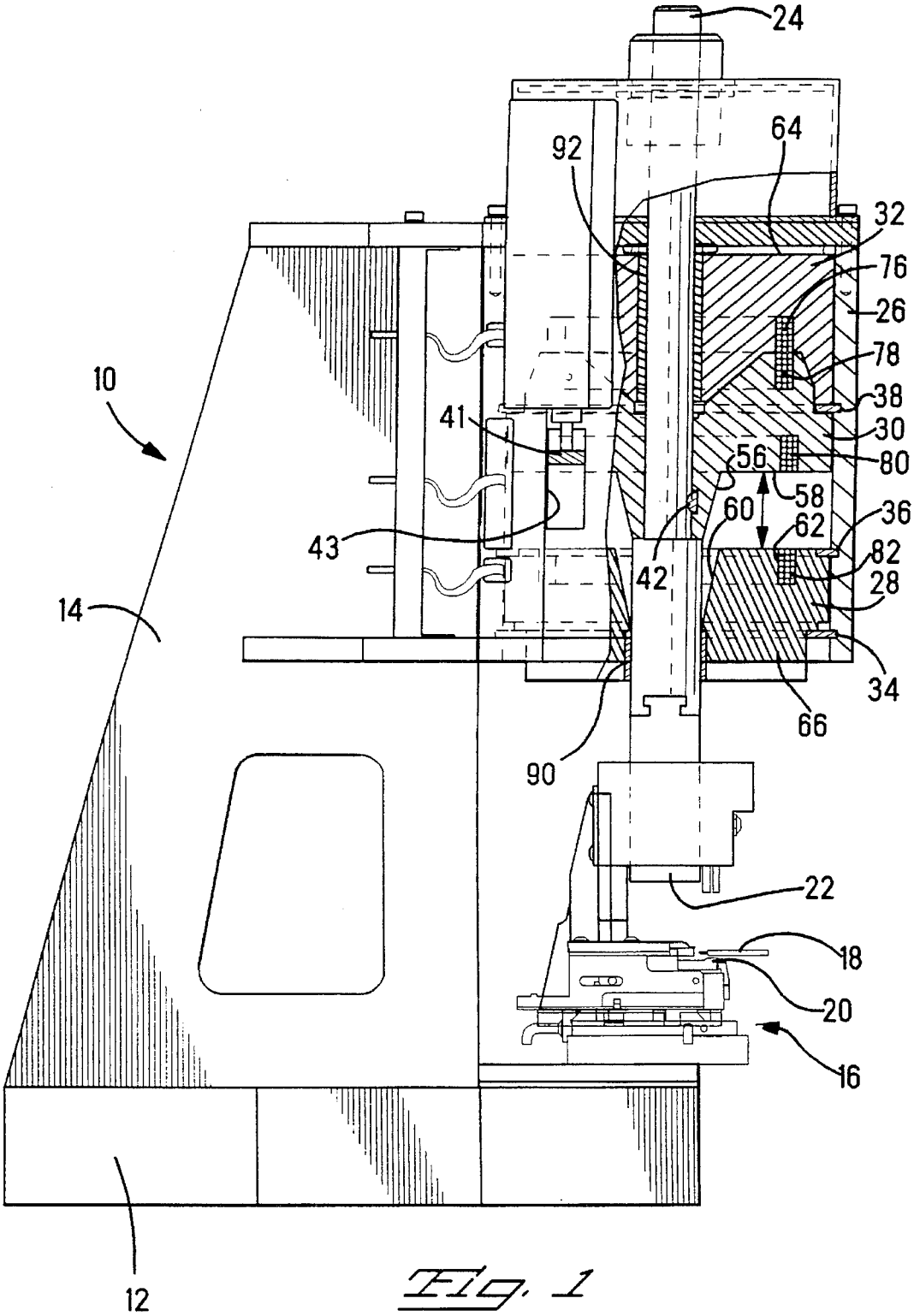
FIG. 1 is a partially sectioned side view of a crimping press having incorporated therein a preferred embodiment of an improved actuator assembly according to this invention, with the central electromagnet member and the ram shaft in their upper positions.
Figure 2:
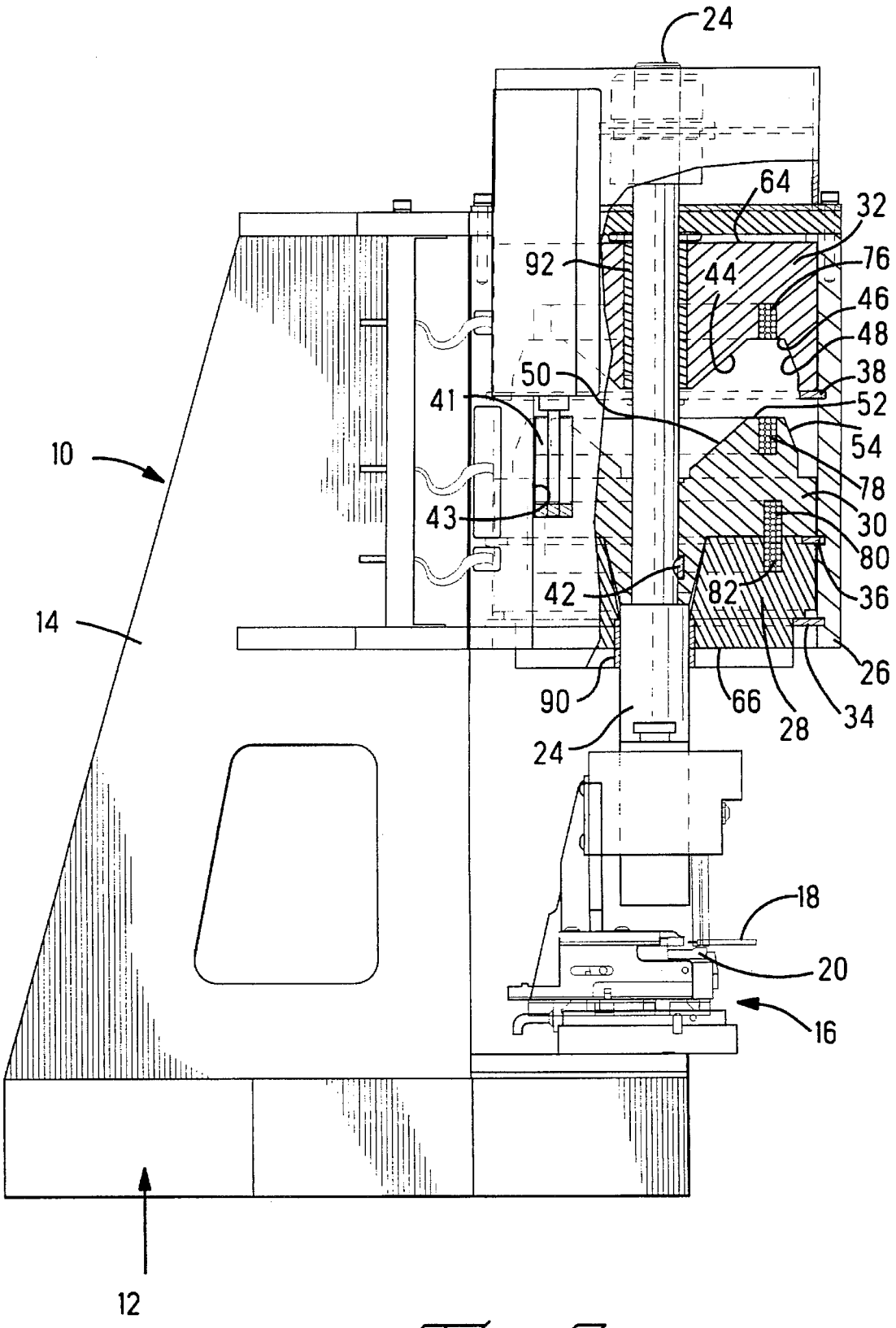
FIG. 2 is a view similar to FIG. 1 with the central electromagnet member and the ram shaft in their lower positions.
Figure 3:
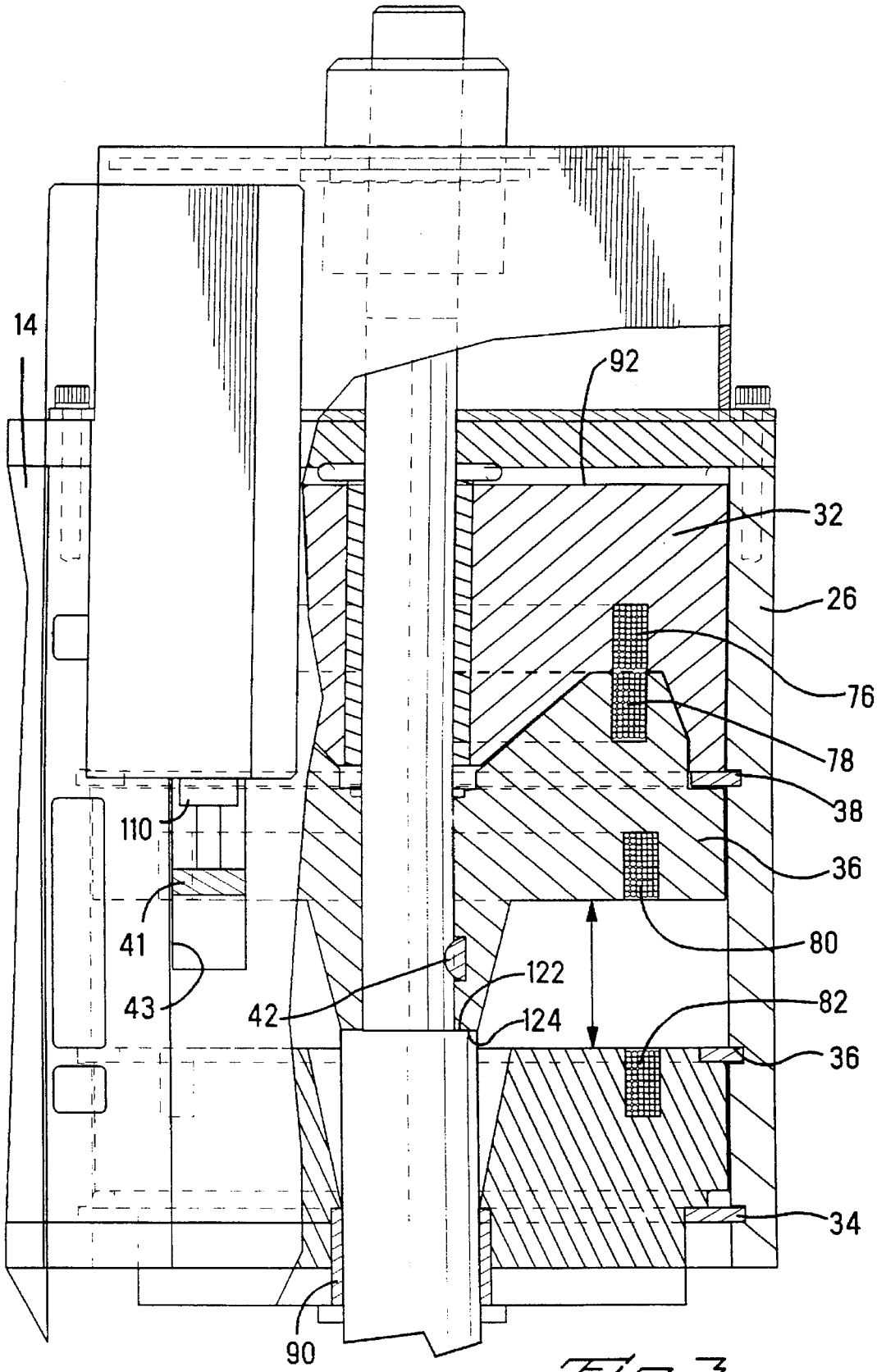
FIG. 3 is an enlarged partially sectioned side view of the actuator assembly showing the central electromagnet member and the ram shaft in their upper positions.

The drawings illustrate a crimping press, designated generally by the reference numeral 10, for securing electrical contact terminals to the ends of electrical wires. The press 10 includes a base 12 and a frame 14. Mounted to the base 12 is an applicator station 16 adapted, as is conventional, to hold a wire 18 and a contact terminal 20 which is supplied in strip form thereto. Cooperating with the applicator station 16 for crimping the terminal 20 to the wire 18 is a ram 22 secured to the lower end of a vertically oriented ram shaft 24. The ram shaft 24 is adapted for vertical reciprocating movement within a generally cylindrical housing 26 of the frame 14 by the actuator assembly according to this invention, as will be described hereinafter.

The actuator assembly according to the present invention is contained within the housing 26 and includes a lower electromagnet member 28, a central electromagnet member 30 and an upper electromagnet member 32. As is clear from FIGS. 4A, 4B, 5A, 5B, 6A and 6B, all of the electromagnet members 28, 30, 32 have circular outer peripheries so that they fit within the cylindrical housing 26. The lower electromagnet member 28 and the upper electromagnet member 32 are restrained from vertical movement within the housing 26, illustratively by the retainer rings 34, 36 and 38. The central electromagnet member 30 is free to move between the lower and upper electromagnet members 28, 32 so as to have a stroke as shown in the drawings. The central electromagnet member 30 is coupled to the ram shaft 24 by a retaining ring 40 and is prevented from rotating in the housing 26 by an encoder actuating arm 41 extending through, and angularly interfering with, a slot 43 cut into the housing 26. The ram shaft 24 is prevented from rotating relative to the central electromagnet member 30 by the Woodruff key 42. Accordingly, vertical reciprocation of the central electromagnet member 30 results in vertical reciprocation of the ram shaft 24 without rotation of the ram shaft 24.

When designing the actuator assembly according to this invention, there were a number of criteria that had to be satisfied. Thus, for example, the ram 22 was required to have a total travel (stroke) of 1.625 inches. The force exerted by the ram 22 at the bottom of its stroke was required to be 5,000 pounds. Approximately half way through the down stroke, a force capability of 175 pounds for feeding the contact terminal 20 is desired. At approximately half way through the up stroke, a force capability of 100 pounds for feeding the contact terminal 20 is desired. The time for a complete cycle of the actuator assembly could not exceed 300 milliseconds. The maximum current draw could not exceed 20 amperes. Finally, there was a maximum voltage requirement of 160 volts DC (equivalent to a rectified 115 volts AC).

The first magnet configuration which was considered included a pair of steel disks with coils embedded in opposing circular channels. It was found that this configuration could not be utilized for two reasons. First, while the magnets produced sufficient attractive force at a small separation, the attractive force at larger distances was too small. Second, because the repulsive force was far too weak to cause the moving magnet to return to its initial position during the up stroke, some alternative means would be required to provide this upward motion. The actuator assembly shown in the drawings overcomes both of these problems.

The first problem was overcome by using magnets with conical features. For flat magnets, the distance between their surfaces at all points is the same as the distance by which the magnets have been separated. However, if a pair of nesting conical magnets is used, the gap between their surfaces is less than the distance by which the magnets have been separated. Computer modeling revealed that although the vertical component of the force between conical magnets was smaller for small separations, it diminished more slowly and was, consequently, larger at large separations. Therefore, the magnets were given flat areas for high force at small separation and conical features for adequate force at large separations. This obviates the need for a supplemental power source, such as an air cylinder or solenoid, to start each stroke. Using a third magnet and an additional pair of coils overcomes the second problem. This third magnet is placed above the moveable magnet and a pair of coils is placed on the bottom of the third magnet and the top of the movable magnet. This configuration provides the force required for the up stroke. Because the up stroke does not require a large force at large separation, the third magnet and the top of the movable magnet are designed much more conically than the lower pair.

Figure 4A:
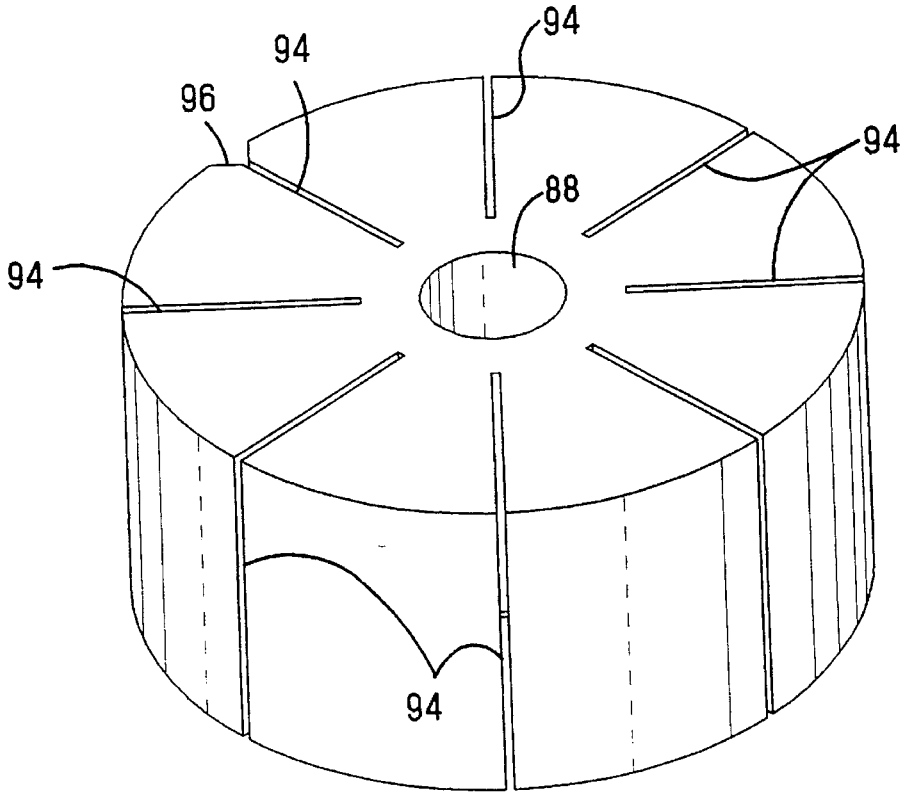
FIGS. 4A and 4B are top and bottom perspective views, respectively, of the upper electromagnet member.
Figure 4B:
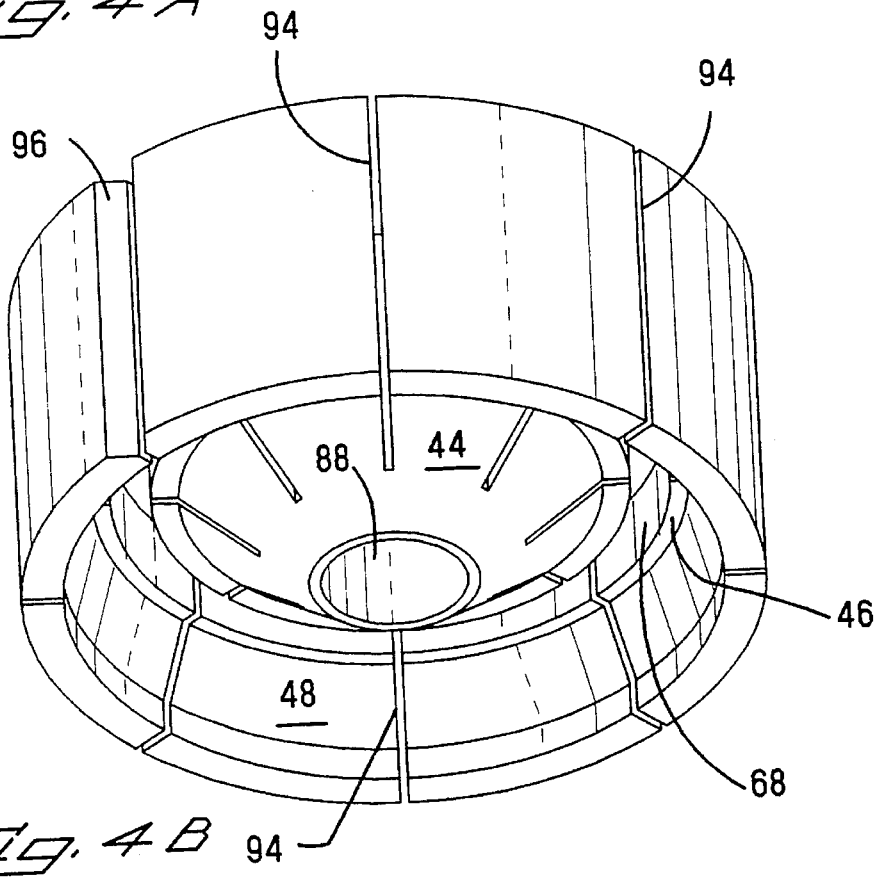
Figure 5A:
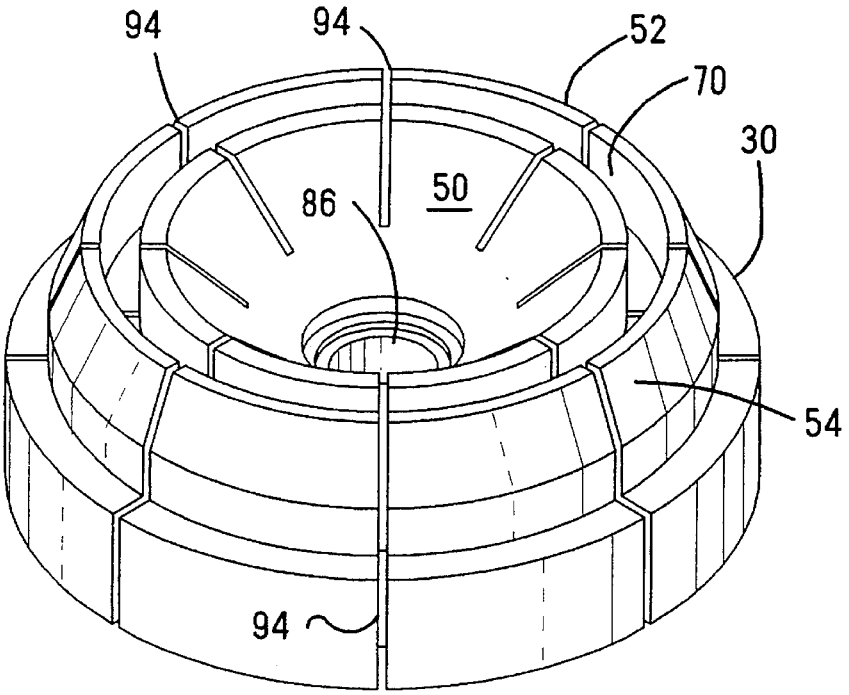
FIGS. 5A and 5B are top and bottom perspective views, respectively, of the/central electromagnet member.
Figure 5B:
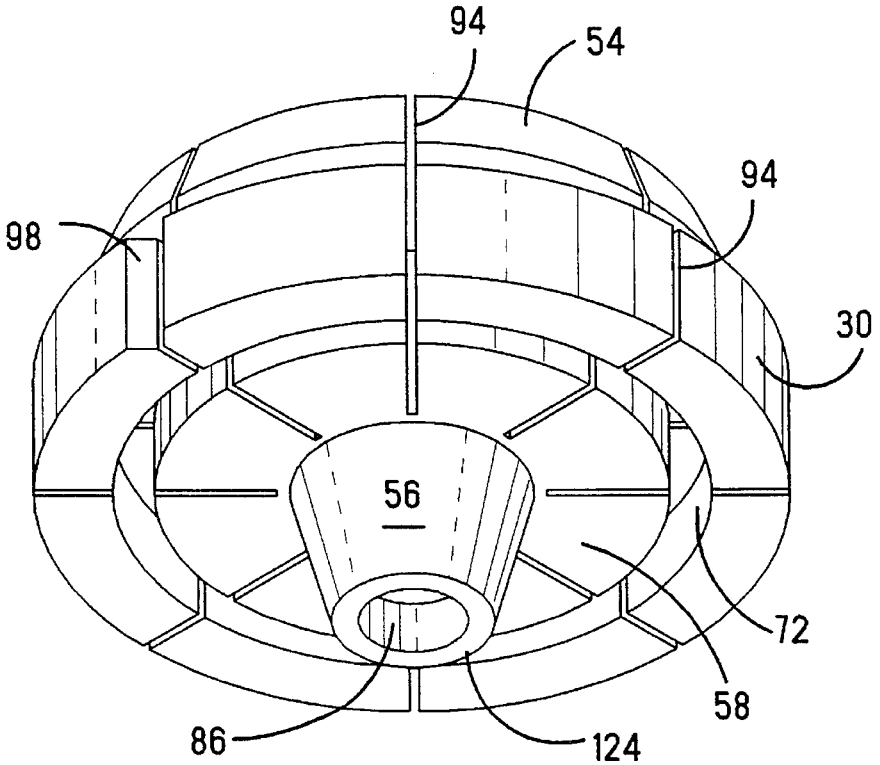
Figure 6A:
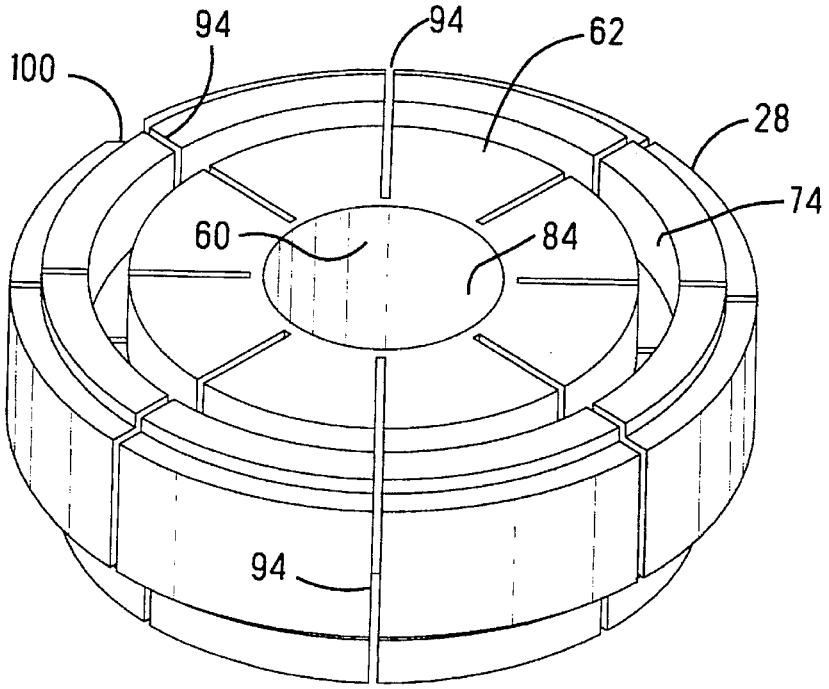
FIGS. 6A and 6B are top and bottom perspective views, respectively, of the lower electromagnet member.
Figure 6B:
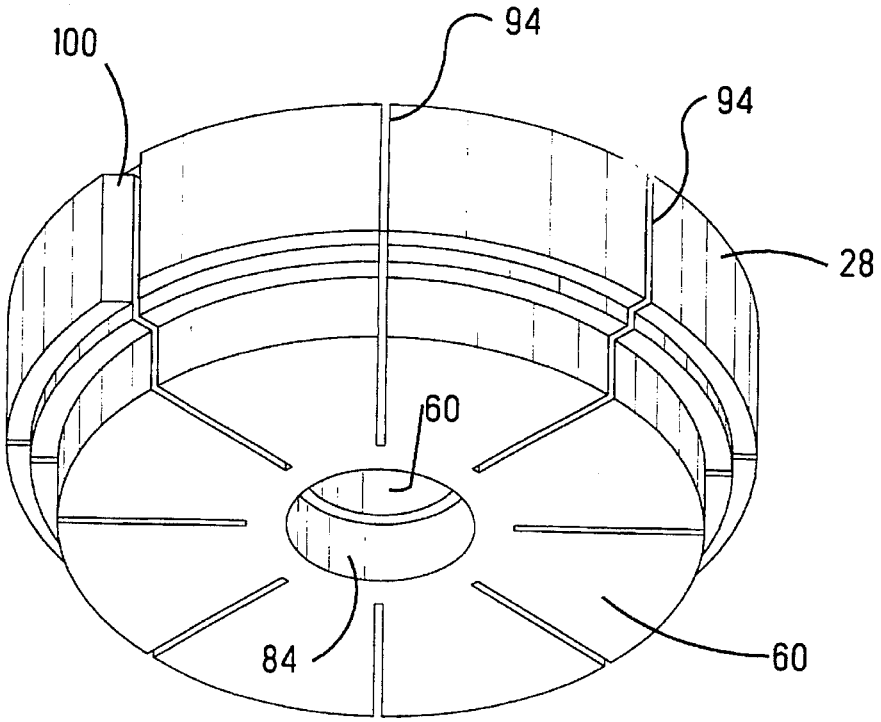

Thus, as shown in FIG. 4B, the upper electromagnet member 32 has its lower surface formed with a relatively large frusto-conical inner region 44 and a relatively small horizontally planar region 46 disposed outwardly of the frusto-conical region 44. In addition, the lower surface of the upper electromagnet member 32 is formed with a further frusto-conical region 48 outwardly beyond the planar region 46. The upper surface of the central electromagnet member 30 is complemental to the lower surface of the upper electromagnet member 32 and therefore includes relatively large frusto-conical inner region 50 for nesting with the frusto-conical region 44 of the upper electromagnet member 32, a horizontally planar region 52 for nesting with the planar region 46 of the upper electromagnet member 32, and an outer frusto-conical region 54 for nesting with the frusto-conical region 48 of the upper electromagnet member 32.

The lower surface of the central electromagnet member 30 is formed with a relatively small frusto-conical inner region 56 and a relatively large horizontally planar region 58 disposed outwardly of the frusto-conical region 56. The upper surface of the lower electromagnet member 28 is formed so as to be complemental with the lower surface of the central electromagnet member 30 and therefore has an inner frusto-conical region 60 for nesting with the frusto-conical region 56 of the central electromagnet member 30 and an outer horizontally planar region 62 for nesting with the planar region 58 of the central electromagnet member 30. The upper surface 64 of the upper electromagnet member 32 and the lower surface 66 of the lower electromagnet member 28 may have any desired configuration. Illustratively, the surfaces 64, 66 are planar.

The electromagnet members 28, 30, 32 are formed of ferromagnetic material, illustratively carbon steel. To form electromagnets, electrical windings must be provided. Accordingly, within each of the planar regions 46, 52, 58 and 62, there is provided a respective annular channel 68, 70, 72 and 74. These channels contain respective electrical windings 76, 78, 80 and 82.

Each of the electromagnet members 28, 30, 32 is formed with a respective central opening 84, 86, 88 for accepting therethrough the ram shaft 24. Specifically, the openings 84 and 88 of the lower and upper electromagnet members 28, 32, respectively, provide clearance for the shaft 38 to move therein. Preferably, sleeve bushings 90 and 92 are provided in the openings 84 and 88, respectively, for providing stability for the ram shaft 24 within the electromagnet members 28, 32.

Each of the electromagnet members 28, 30, 32 is further formed with a plurality of slits 94 which extend radially inwardly from the outer periphery of the respective electromagnet member. One purpose of the slits 94 is to reduce eddy currents in the electromagnet members 28, 30, 32. Further, the slits 94 intersect the annular channels 70, 72, 74 so that a second purpose of the slits 94 is to act as passageways for the wires forming the windings 76, 78, 80, 82. Illustratively, one or more of the slits 94 has a V-shaped groove at the outer periphery, as shown at 96, 98, 100 to assist in the entry and exit of the wires from the slits 94.

As described above, the frusto-conical regions 44, 48, 50 and 54 of the upper and lower electromagnet members 32, 30 are relatively large to provide sufficient attractive force when the windings 76, 78 are energized to raise the central electromagnet member 30 from its initial lowermost position where the separation is largest. The planar regions 46 and 52 can be relatively small because only a small force is required to maintain the central electromagnet member 30 in its upper position. Based upon such geometric considerations, it has been found that a preferred range for the apex angle of the frusto-conical regions 44 and 50 is from about 35° to about 45° and the preferred range for the apex angle of the frusto-conical regions 48 and 54 is from about 20° to about 25°.

The frusto-conical regions 56 and 60 of the central electromagnet member 30 and the lower electromagnet member 28 are relatively small and are sufficient merely to initially accelerate the central electromagnet member 30 when the windings 80 and 82 are energized, the planar regions 58 and 62 providing the large force necessary at the bottom of the stroke to crimp the contact terminal 20 to the wire 18. Accordingly, a preferred range for the apex angle of the frusto-conical regions 56 and 60 is from about 10° to about 15°.

Figure 7:
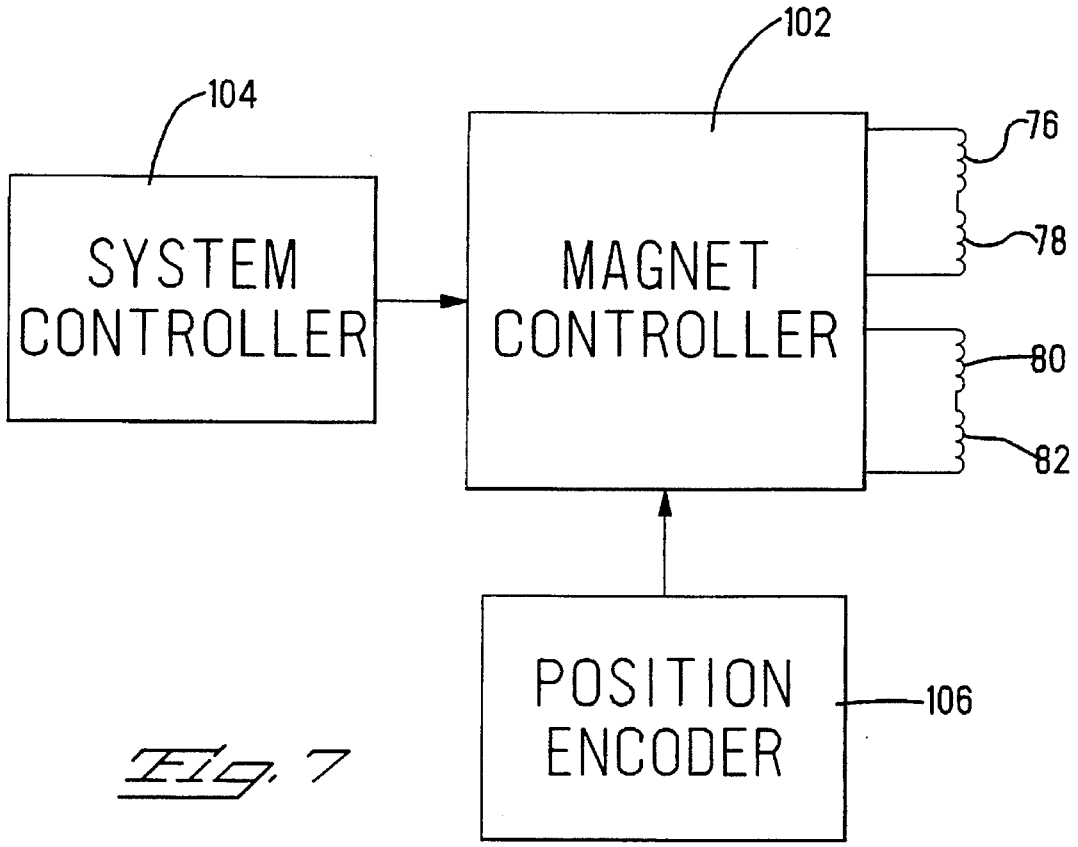
FIG. 7 is a block diagram of an illustrative control system for the actuator assembly according to this invention.

As shown in FIG. 7, the windings 76 and 78 are connected in series with each other and the windings 80 and 82 are connected in series with each other, both pairs being connected to the magnet controller 102. The magnet controller 102 is effective to energize the pair of windings 76, 78 to cause an attraction between the upper electromagnet member 32 and the central electromagnet member 30 so as to raise the central electromagnet member 30 and thereby raise the ram shaft 24. The magnet controller 102 is also effective to energize the pair of windings 80 and 82 to cause attraction between the central electromagnet member 30 and the lower electromagnet member 28 so as to lower the central electromagnet member 30 and the ram shaft 24. It is to be noted that winding pair 76, 78 is never energized at the same time as the winding pair 80, 82. The magnet controller 102 performs its cycling in response to signals received from the system controller 104, which in its simplest form may be a foot switch controlled by a machine operator.

Figure 8:
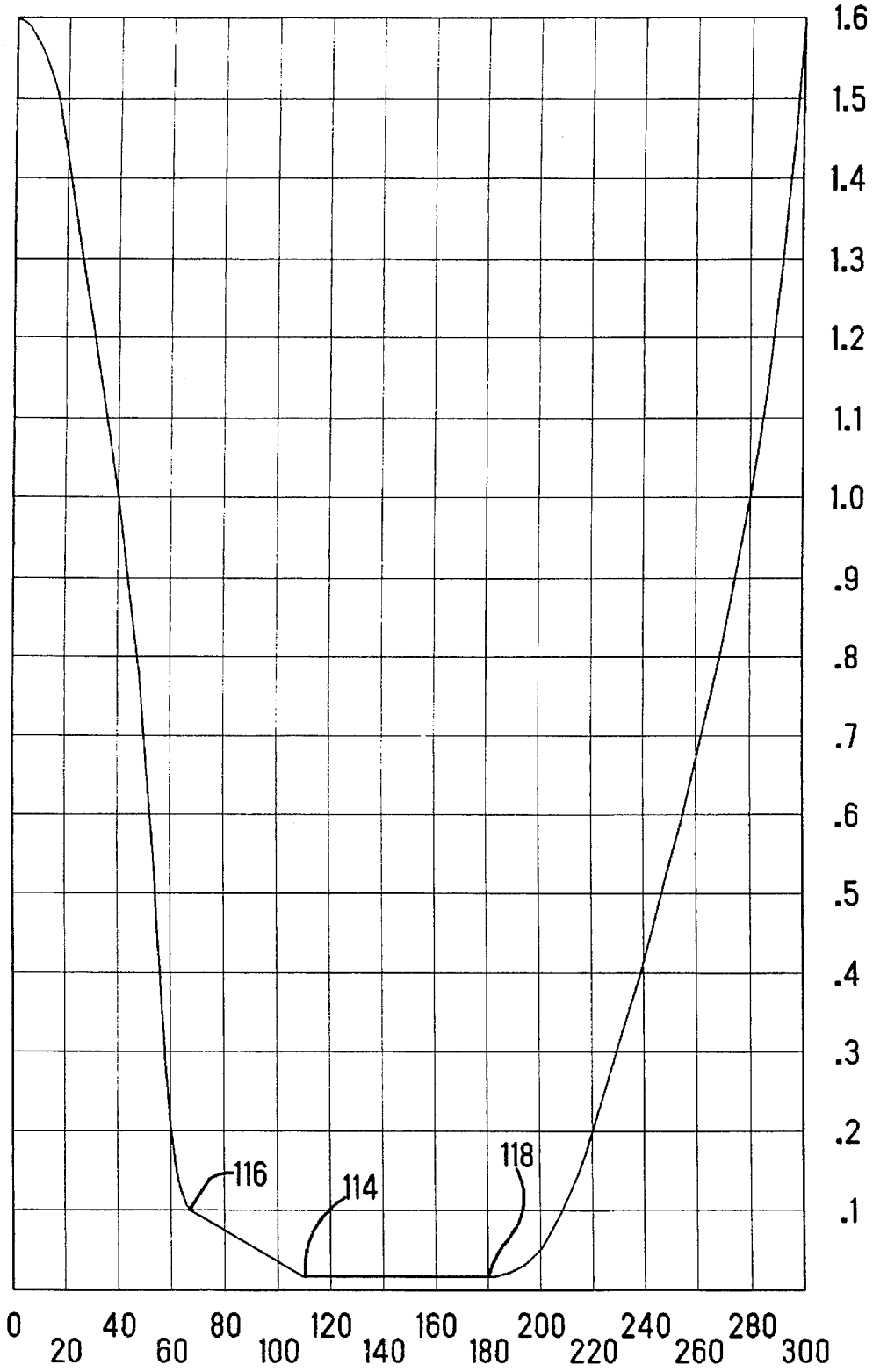
FIG. 8 is a chart showing a preferred trajectory (vertical position vs. time) for the central electromagnet member.

The magnet controller 102 may include a programmed microprocessor which is effective to control the energization of the windings 76, 78, 80, 82 to achieve the illustrative vertical position versus time trajectory shown in FIG. 8. Accordingly, the magnet controller 102 receives an input from a position encoder 106. The position encoder 106 illustratively includes a linear scale member 108 fixedly secured to the central electromagnet member 30 via the actuating arm 41 which extends outside the cylindrical housing 26 through the slot 43, and a stationary scale sensor 110 secured to the cylindrical housing 26. Referring now to FIG. 8, the magnet controller 102 energizes the windings 80 and 82 from the point 112 to the point 114 to effect the down stroke of the ram shaft 24, where the crimping of the contact terminal 20 occurs from the point 116 to the point 114. After a period of non-energization, the magnet controller 102 energizes the windings 76 and 78 from the point 118 to the point 120 to effect the up stroke of the ram shaft 24.

To insure that downward movement of the central electromagnet member 30 results in downward movement of the ram shaft 24 with adequate force at the bottom of the stroke, the ram shaft 24 is formed with a shoulder 122 which is engaged by a planar region 124 on the lower surface of the central electromagnet member 30 immediately outward of the central opening 86. The shoulder 122 is larger than the central opening 86.

A further advantage of the aforedescribed actuator assembly is that, by using position encoder feedback, the magnet controller 102 can cause precise crimping to a desired dimension, without requiring manual calibration of the press.

Accordingly, there has been disclosed an improved magnetic actuator assembly for reciprocating a ram shaft in a crimping press. While an illustrative embodiment of the present invention has been disclosed herein, it is understood that various modifications and adaptations to the disclosed embodiment will be apparent to those of ordinary skill in the art and it is intended that this invention be limited only by the scope of the appended claims.

What is claimed is:

1. An actuator assembly for reciprocating a ram shaft in a crimping press having a frame, the ram shaft being adapted for vertical reciprocating movement within said frame, the actuator assembly comprising:

an upper electromagnet member mounted to said frame so as to be restrained from vertical movement, said upper electromagnet member having a lower surface;

a lower electromagnet member mounted to said frame so as to be restrained from vertical movement, said lower electromagnet member having an upper surface;

a central electromagnet member disposed for vertical movement within said frame between said upper and lower electromagnet members and coupled to control movement of said ram shaft, said central electromagnet member having an upper an a lower surface; and control means for controlling the magnetization of said upper, lower and central electromagnet members so as to effect vertical reciprocating movement of said ram shaft;

wherein the lower surface of said upper electromagnet member and the upper surface of said central electromagnet member are complementary so as to mesh one with the other and have a relatively large frusto-conical inner region and a relatively small horizontally planar region disposed outwardly of the frusto-conical inner region, and the lower surface of said central electromagnet member and the upper surface of said lower electromagnet member are complementary so as to mesh one with the other and have a relatively small frusto-conical inner region and a relatively large horizontally planar region disposed outwardly of the frusto-conical inner region.

2. The actuator assembly according to claim 1 wherein:

said upper electromagnet member is formed with an annular channel in its lower surface planar region;

said central electromagnet member is formed with an annular channel in its upper surface planar region and an annular channel in its lower surface planar region;

said lower electromagnet member is formed with an annular channel in its upper surface planar region; and said control means includes four electrical wire windings each disposed in a respective one of said annular channels.

3. The actuator assembly according to claim 2 wherein said control means further includes means for selectively energizing said windings in adjacent pairs so as to alternately cause attractive forces between said upper and central electromagnet members and between said central and lower electromagnetic members.

4. The actuator assembly according to claim 2 wherein the frusto-conical inner region of said upper and central electromagnet members has an apex angle in the range from about 35° to about 45° and the frusto-conical inner region of said central and lower electromagnet members has an apex angle in the range from about 10° to about 15°.

5. The actuator assembly according to claim 2 wherein each of said upper, central and lower electromagnet members has a circular outer periphery concentric with the respective annular channels and is formed with a plurality of slits extending radially inwardly from the outer periphery to reduce eddy currents in the electromagnet members.

6. The actuator assembly according to claim 5 wherein said slits intersect said annular channels so as to be usable as passageways for the wires forming said windings.

7. The actuator assembly according to claim 1 wherein:

each of said upper, central and lower electromagnet members has a generally circular outer periphery; and said upper electromagnet lower surface and said central electromagnet upper surface are formed with a further frusto-conical region outwardly beyond the relatively small horizontally planar outer region.

8. The actuator assembly according to claim 7 wherein said further frusto-conical region has an apex angle in the range from about 20° to about 25°.

9. The actuator assembly according to claim 1 wherein said control means includes position encoding means coupled to said central electromagnet member for providing a position signal indicative of the vertical position of said central electromagnet member.

10. The actuator assembly according to claim 9 wherein said position encoding means comprises a linear position encoder having a linear scale member fixedly secured to said central electromagnet member and a stationary scale sensor cooperating with said scale member to provide said position signal.

11. The actuator assembly according to claim 1 wherein said upper, central and lower electromagnet members each has a central opening, said ram shaft extends through said central openings, and the central openings of said upper and lower electromagnet members provide clearance for said ram shaft to move freely therein.

12. The actuator assembly according to claim 11 wherein said applicator ram shaft is formed with a shoulder larger than the central opening of the central electromagnet member, the shoulder being engaged by the lower surface of said central electromagnet member to move said ram shaft downwardly when said control means effects a magnetization of said central and lower electromagnet members which causes a magnetic attraction between said central and lower electromagnet members.

* * * * *